US005818949A

United States Patent [19]

Deremer et al.

[11] Patent Number: 5,818,949

[45] Date of Patent: Oct. 6, 1998

[54] MICROPHONE WITH INFARED ON/OFF SWITCH

[76] Inventors: Dale D. Deremer, 857 Carlisle Way, #2, Sunnyvale, Calif. 94087; Arthur G. Gora, 1014 Morse Ave., #14, Sunnyvale, Calif. 94089-1635

[21] Appl. No.: 747,453

[22] Filed: Nov. 12, 1996

Related U.S. Application Data

[63] Continuation of Ser. No. 214,379, Mar. 17, 1994, abandoned.

[51] Int. Cl.[6] ..... H04R 25/00

[52] U.S. Cl. ..... 381/172; 381/79; 381/123

[58] Field of Search ..... 381/172, 168, 381/169, 77, 79, 355, 361, 122, 123; 250/338.1, 341.8, 342, DIG. 1, 221; 340/552, 555, 556, 557, 679; 359/155, 169

[56] References Cited

U.S. PATENT DOCUMENTS

| | | | |
|---|---|---|---|
| 4,207,466 | 6/1980 | Drage et al. | 250/338.1 |
| 4,290,043 | 9/1981 | Kaplan | 359/155 |
| 4,349,814 | 9/1982 | Akehurst | 340/679 |
| 5,347,386 | 9/1994 | Gibbs et al. | 359/169 |

*Primary Examiner*—Vivian Chang

*Attorney, Agent, or Firm*—Sawyer & Associates

[57] ABSTRACT

A microphone including an infrared switch circuit is disclosed. The infrared switch circuit includes an infrared detector for detecting a reflection of an infrared signal off an object such as a human body, and producing an electrical signal. The circuit also includes an amplifier for amplifying the electrical signal and a comparator for determining if the amplified electrical signal is above a predetermined threshold. The switching finally includes a audio switching network for providing the amplified signal as an audio signal if the amplified signal is above a predetermined threshold. The circuit also includes power conservation techniques to improve performance.

12 Claims, 2 Drawing Sheets

MICROPHONE WITH INFARED ON/OFF SWITCH

This application is a continuation of application Ser. No. 08/214,379 filed on Mar. 17, 1994, now abandoned.

FIELD OF THE INVENTION

The present invention relates to microphone switching and more specifically means for automatically switching a microphone on and off.

BACKGROUND OF THE INVENTION

Microphones as are well known are utilized to provide an output signal to a device such as a speaker, tape recorder or other audio device. There has always been a need to be able to easily enable and disable the output signal of the microphone. For example, it is well known to use a manual on/off switch that is built into a microphone assembly to disable and enable the output signal of the microphone. Although these manual switches operate effectively for some purposes, they have problems for some applications.

Firstly, the switch will fail after a certain amount of use. Secondly, there is oftentimes audible switch noise enabling or disabling the microphone. Thirdly, if for example, the user is playing a musical instrument that requires the use of two hands, it is not possible for the user to turn the microphone on and off. Finally, the user may forget to turn the microphone on or off at the appropriate time.

One way of addressing the enabling and disabling of the output signal of the microphone in the audio environment is to place the responsibility on an individual such as a sound technician to control the status and volume of the microphone. The problem with this solution in a recording studio, live sound reinforcement situation or the like is that there may be many microphones for the technician to monitor and the technician may forget to turn a microphone on or off due to human error. Furthermore, the technician must have full knowledge of the program material to ensure that the microphones are operated in the proper manner. In addition, many professional microphones do not have on-off switches. Finally, this solution can be relatively expensive due to cost of the additional personnel (for example, the sound technician) to monitor the microphones.

The next step in solving the microphone switching problem was to use audio signal operated switches, hereinafter called noise gates, to control the on/off state of the microphone. These noise gates are utilized in some hand held tape recorders, for example, for recording therewith.

However, the problem with the noise gate for control of the enabling and disabling of a microphone is that since noise gates respond to audio signals, these types of switches cannot determine the difference between a valid signal and unwanted noise. In addition, the noise gates will oftentimes chop off the beginning of the program material. The use of noise gates may also have breathing effects, the unwanted audible rise and fall of background noise that may occur with a noise gate, during turn on or shut off. Noise gates are also oftentimes difficult to adjust during use based on changing ambient noise conditions. Finally, audio feedback will oftentimes cause the noise gate to remain on even when the microphone should be off.

Accordingly, what is needed is a microphone switch which solves the problems associated with known conventional switches in microphone assemblies. The solution should be cost effective and simple to implement. The present invention addresses such a need.

SUMMARY OF THE INVENTION

An improved switch for a microphone is disclosed that provides for infrared emission detection and response. In a first aspect, the switch comprises infrared detecting means for detecting an infrared reflection of an object and providing an electrical signal based upon that infrared reflection; and audio signal means coupled to the detecting means for providing an audio signal responsive to the electrical signal if the signal is above a predetermined threshold.

In another aspect of the present invention, the infrared detecting means comprises infrared emitter means for providing a pulse on the object to be detected; and a detector means responsive to the emitter means for detecting the reflection from the object and providing the electrical signal.

In another aspect of the present invention, the switch further includes an amplifier means coupled to the detector means for amplifying the electrical signal.

In yet another aspect of the present invention, the switch further includes a comparator means coupled to the amplifier means for determining if the amplified electrical signal is above a predetermined threshold.

In another aspect of the present invention, the switch further comprises a pulse stretching means coupled to the comparator means for driving the amplified electrical signal if the amplified electrical signal is above the predetermined threshold.

In a final aspect of the present invention, the audio signal means further comprises an audio switching means coupled to the pulse stretching means for providing an audio signal if the amplified electrical signal is above the predetermined threshold; and an audio signal line coupled to the audio switching network for providing the audio signal to an output.

Through the present invention an automatic switch circuit for a microphone is provided that minimizes audio switching noise and the like and is more reliable than known automatic switches utilized with microphones.

DETAILED DESCRIPTION

The present invention comprises an improvement in a switching circuit for a microphone. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown but is to be accorded the widest scope consistent with the principles and features described herein.

The present invention is directed toward enabling the microphone or other sound producing device by proximity of a human body or large object to the microphone through infrared emissions. In a typical public address system, overall noise is increased by the number of open audio channels being reproduced. By turning off these channels using this circuit, cumulative noise is reduced, additional headroom is achieved, and the appropriate channels are enabled at the more appropriate time. To more specifically describe the advantages and features of the present invention refer now to FIGS. 1 and 2.

Figure 1:
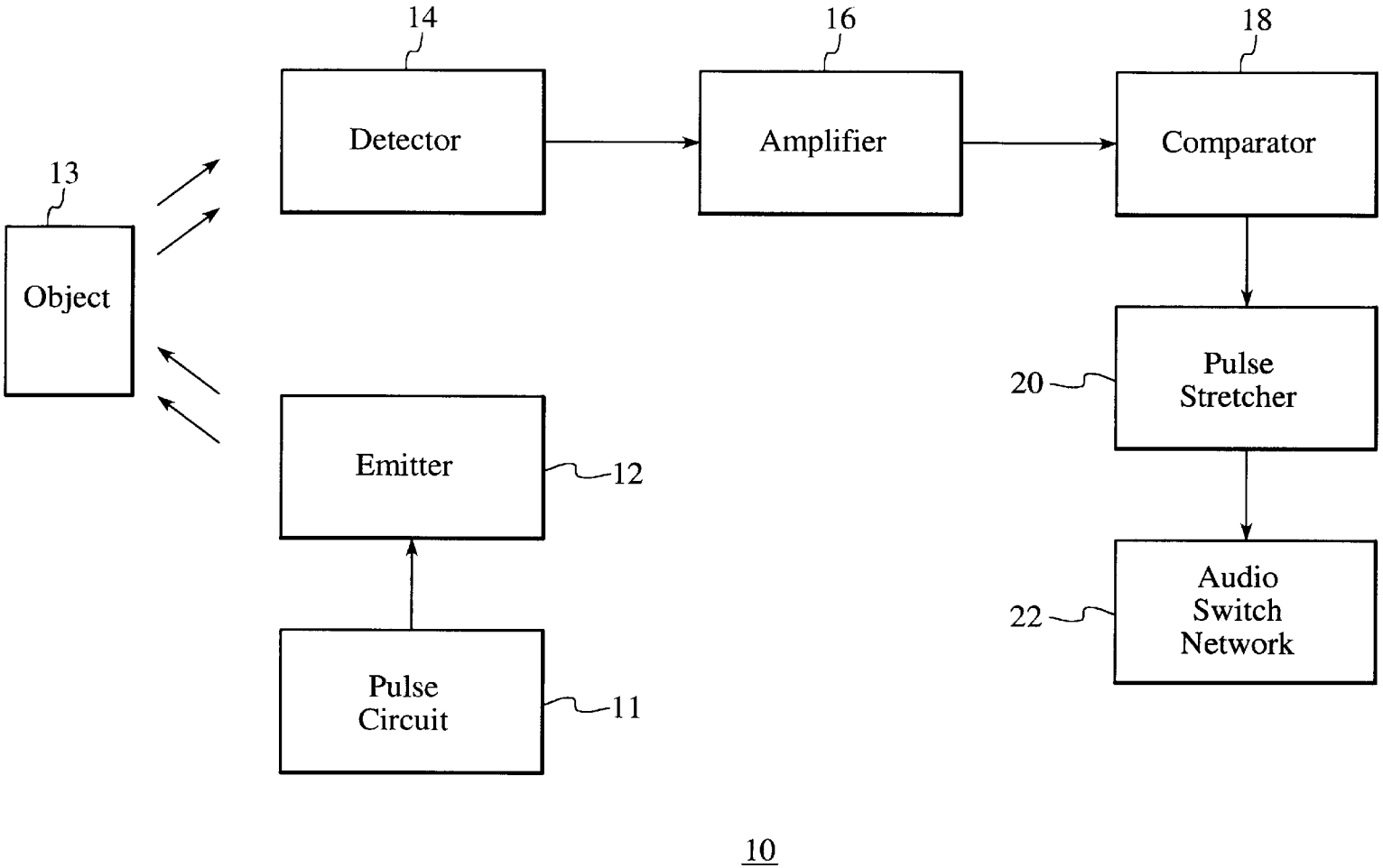
FIG. 1 is a simple block diagram of a microphone switching system in accordance with the present invention.

Referring now to FIG. 1, what is shown in a simple block diagram form is an infrared switch circuit 10 which is typically located within or adjacent to a microphone assembly (not shown). The switch circuit 10 comprises a pulse circuit 11, an infrared emitter 12 which provides a signal to infrared detector 14. The infrared detector 14 is coupled to a amplifier 16. The amplifier 16 is coupled to a comparator 18. The pulse stretcher circuit 20 is in turn coupled to an audio switch network 22.

In operation, the pulse circuit 11 places a short pulse into the infrared emitter 12. The emitter is pointed in the direction of an object 13 to be sensed.

Correspondingly, an infrared detector 14 detects the reflection from the object 13, (usually a human body), and produces an electrical signal. The electrical signal from detector 14 is amplified via the amplifier 16. The electrical signal after amplification and comparison is provided to a pulse stretcher circuit 20 which drives the audio switch network 22. The pulse stretcher circuit 20 turns on the switch circuit 10 quickly and keeps the switch circuit 10 on for a predetermined period of time.

The audio switching network 22 switches from a high impedance to low impedance state dependent upon the value of the signal from the comparator 18. The low impedance state allows the audio signal to be provided to an output.

The circuit 10 of the present invention provides for a minimum number of devices to accomplish this audio switching function, which can be incorporated into a microphone or other sound producing device. It also uses advantageously infrared based optical pulse detection which significantly improved switching over conventional microphone switching arrangements. The circuit of the present invention also allows for lower power consumption during operation than conventional automatic switches associated with microphones.

Figure 2:
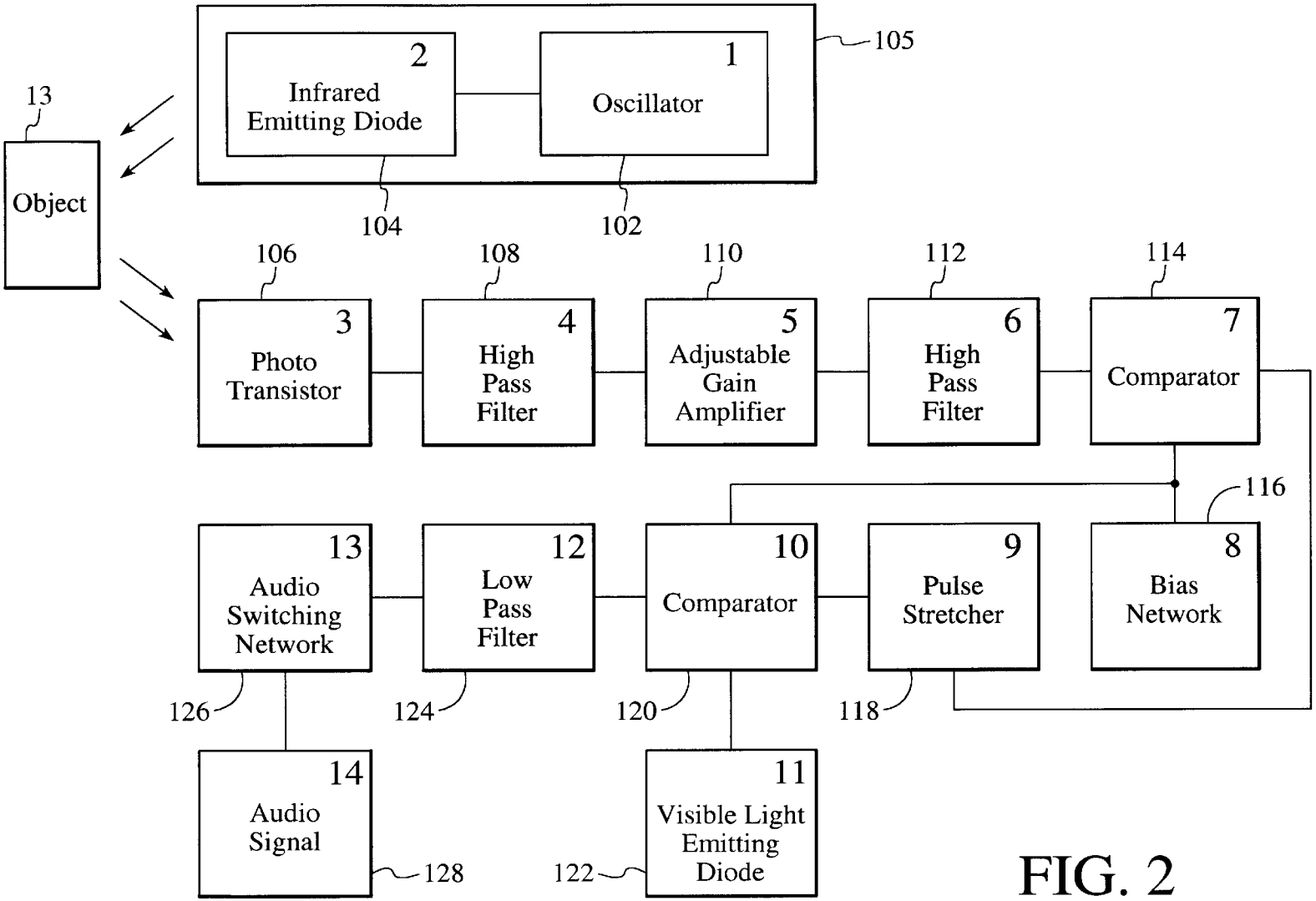
FIG. 2 is a detailed block diagram of a microphone switching system in accordance with the present invention.

To more particularly describe the advantages of the present invention refer now to FIG. 2 which is a more detailed block diagram of a circuit 100 in accordance with the present invention.

The circuit 100 includes an oscillator 102 coupled to an infrared emitting diode 104, the combination of which comprises an infrared emitter 105. The infrared emitter 105 provides a signal reflected to photo transistor 106. The photo transistor is coupled to a first high pass filter 108. The first high pass filter 108 is coupled to an adjustable gain amplifier 110.

The adjustable gain amplifier 110 is coupled to a second high pass filter 112. The second high pass filter 112 is coupled to a first comparator 114. The first comparator 114 is coupled to a bias network 116, pulse stretcher 118, and a second comparator 120.

The pulse stretcher 118 is also coupled to the second comparator 120. The second comparator 120 is also coupled to a visible light emitting diode (LED) 122 and a low pass filter 124. The low pass filter 124 is coupled to an audio switching network 126. The audio switching network 126 in turn is coupled to the audio signal line 128.

To more particularly describe operation of the circuit 100, FIG. 2, refer now to the following discussion.

A pulse is generated by the oscillator 102 at some predetermined rate (for example ⅓ second) to the infrared emitting diode 104. This emitted infrared pulse is detected by the infrared photo transistor 106 when an object 13 is in proximity of the infrared beam. The output pulse from photo transistor 106 is provided to the first high pass filter 108. The high pass filter signal is then provided to the adjustable gain amplifier 110. The gain adjustment offers adjustable minimum to maximum detection distance.

The output of the adjustable gain amplifier 110 is provided to the second high pass filter 112 and then input to the first comparator 114. Comparator 114 has a threshold set by the bias network 116. If the incoming pulse is above the comparator 114 threshold an output pulse is provided to pulse stretcher 118 from the first comparator 114.

The effect of the pulse stretcher 118 is to turn on quickly and remain on for a preset period of time after no input signal from the comparator. The output of the pulse stretcher 18 is applied to the second comparator 120 which is also biased by the bias network 116. The output of comparator 120 is coupled to the visible LED 122. The visible LED 122 provides a visual indication that the switch is either enabled or disabled. The comparator 120 output is also provided to a low pass filter 124.

The low pass filter 124 limits the slew rate of the comparator output to eliminate any switching noise. The output of the low pass filter 124 is provided to the audio switching network 126. The audio switching network 126 is coupled to the audio signal line 128 to be controlled. The audio signal line 128 may be a single ended or a balanced line type.

The audio switching network 126 provides a high impedance across the audio signal line 126 which attenuates the audio signal line 128 until the signal from the low pass filter 124 exists. At this point the audio switching network 126 becomes a low impedance to pass the audio signal.

Through the use of the present invention, an automatic switch circuit is provided for a microphone or other type of audio device that does not have the problems associated with conventional switches. In addition it is easily implemented utilizing infrared optical technology and utilizes a relatively small number of elements.

Although the present invention has been described in accordance with the embodiments shown in the figures one of ordinary skill in the art will recognize there could be variations to those embodiments and those variations would be within the spirit and scope of the present invention.

It should be readily recognizable for example, the present invention could be utilized in a variety of applications, such as with tape recorders, hand held video cameras, disk tape recorders or the like and this use would be within the spirit and scope of the present invention.

Accordingly, many modifications may be made by one of ordinary skill in the art without departing from the spirit and scope of the present invention, the scope of which is defined solely by the appended claims.

What is claimed is:

1. A switching circuit utilized in a microphone assembly comprising:

an infrared emitter means for providing a pulse to an object to be detected, the object being proximate to the infrared detecting means;

an infrared detector means responsive to the pulse emitter means for detecting a reflection from the proximate object;

an amplifier means coupled to the detector means providing an electrical signal for amplifying the electrical signal;

a comparator means coupled to the amplifier means for determining if the amplified electrical signal is above a predetermined threshold;

a pulse stretching means coupled to the comparator means for driving the amplified electrical signal if the amplified electrical signal is above the predetermined threshold; and an audio switching means coupled to the pulse stretching means for providing switching of an audio signal input to the microphone if the amplified electrical signal is above the predetermined threshold, wherein the microphone assembly is enabled when the amplified electrical signal is above the predetermined threshold.

2. The switching circuit of claim 1 which further includes an audio signal line coupled to the audio switching means for providing the audio signal to an output.

3. The switching circuit of claim 1 in which the infrared emitter comprises:

an infrared emitting diode; and an oscillator coupled to the infrared emitting diode.

4. The switching circuit of claim 1 which further includes a visible light emitting diode coupled to the comparator means for providing a visual indication that the switching circuit is enabled.

5. The switching circuit of claim 1 in which the infrared detector comprises a photo transistor.

6. The switching circuit of claim 1 which further includes a low pass filter coupled to the comparator means and the switching means for limiting a slew rate of the comparator.

7. The switching circuit of claim 1 in which the amplifier means is adjustable to provide a predetermined range of gain.

8. The switching circuit of claim 1 which further includes a bias means coupled to the comparator means for setting the predetermined threshold within the comparator means.

9. A switching circuit utilized in a microphone assembly comprising:

an infrared emitter means for providing a pulse on an object to be detected, the object being proximate to the infrared emitter means, the infrared emitter further including an infrared emitting diode and an oscillator coupled to the infrared emitting diode;

an infrared detector means responsive to the pulse emitter means for detecting a reflection from the proximate object;

an amplifier means coupled to the detector means providing an electrical signal for amplifying the electrical signal;

a comparator means coupled to the amplifier means for determining if the amplified electrical signal is above a predetermined threshold;

a bias means coupled to the comparator means for setting the predetermined threshold within the comparator means;

a pulse stretching means coupled to the comparator means for driving the amplified electrical signal if the amplified electrical signal is above the predetermined threshold;

an audio switching means coupled to the pulse stretching means for providing switching of an audio signal input to the microphone if the amplified electrical signal is above the predetermined threshold;

a low pass filter coupled to the comparator means and the audio switching means for limiting a slew rate of the comparator; and an audio signal line coupled to the audio switching means for providing the audio signal to an output, wherein the microphone assembly is enabled when the amplified electrical signal is above the predetermined threshold.

10. The switching circuit of claim 9 which further includes a visible light emitting diode coupled to the comparator means for providing a visual indication that the switching circuit is enabled.

11. The switching circuit of claim 9 in which the infrared detector comprises a photo transistor.

12. The switching circuit of claim 9 in which the amplifier means is adjustable to provide a predetermined range of gain.

* * * * *

UNITED STATES PATENT AND TRADEMARK OFFICE

CERTIFICATE OF CORRECTION

PATENT NO. : 5,818,949
DATED : October 6, 1998
INVENTOR(S) : Dale D. Deremer, et al.

It is certified that error appears in the above-identified patent and that said Letters Patent is hereby corrected as shown below:

On the title page, item [54], and in column 1, line 1, "infared" should read--infrared--.

Signed and Sealed this

Twenty-sixth Day of January, 1999

*Attest:*

*Attesting Officer*

*Acting Commissioner of Patents and Trademarks*